US007157640B2

(12) United States Patent
Baggs

(10) Patent No.: US 7,157,640 B2
(45) Date of Patent: Jan. 2, 2007

(54) UNDERSADDLE PICKUP FOR STRINGED MUSICAL INSTRUMENT

(76) Inventor: Lloyd R. Baggs, 483 N. Frontage Rd., Nipomo, CA (US) 93444

( * ) Notice: Subject to any disclaimer, the term of this patent is extended or adjusted under 35 U.S.C. 154(b) by 320 days.

(21) Appl. No.: 10/464,066

(22) Filed: Jun. 17, 2003

(65) Prior Publication Data

US 2004/0255763 A1 Dec. 23, 2004

(51) Int. Cl.
*G10H 3/18* (2006.01)

(52) U.S. Cl. ..... 84/731

(58) Field of Classification Search ..... 84/730, 84/731

See application file for complete search history.

(56) References Cited

U.S. PATENT DOCUMENTS

| | | | |
|---|---|---|---|
| 2,324,024 | A | 7/1943 | Ream |
| 2,420,864 | A | 5/1947 | Chilowsky |
| 2,456,995 | A | 12/1948 | Robinson |
| 2,769,867 | A | 11/1956 | Crownover et al. |
| 3,070,775 | A | 12/1962 | Andrews, Jr. |
| 3,291,887 | A | 12/1966 | Carman et al. |
| 3,325,580 | A | 6/1967 | Barcus et al. |
| 3,538,232 | A | 11/1970 | Bachtig et al. |
| 3,600,497 | A | 8/1971 | Zanessi |
| 3,712,951 | A | 1/1973 | Rickard |
| 3,792,204 | A | 2/1974 | Murayama et al. |
| 3,858,480 | A | 1/1975 | Schneider et al. |
| 4,135,426 | A | 1/1979 | Rickard |
| 4,147,084 | A | 4/1979 | Underwood |
| 4,189,969 | A | 2/1980 | Katayama et al. |
| 4,230,013 | A | 10/1980 | Wellings |
| 4,278,000 | A | 7/1981 | Saito et al. |
| 4,290,331 | A | 9/1981 | Izdebski |
| 4,314,495 | A | 2/1982 | Baggs |
| 4,356,754 | A | 11/1982 | Fishman |
| 4,491,051 | A | 1/1985 | Barcus |
| 4,514,247 | A | 4/1985 | Zola |
| 4,580,480 | A | 4/1986 | Turner |
| 4,633,121 | A | 12/1986 | Ogawa et al. |
| 4,634,917 | A | 1/1987 | Dvorsky et al. |
| 4,657,114 | A | 4/1987 | Shaw |
| 4,727,634 | A | 3/1988 | Fishman |
| 4,774,867 | A | 10/1988 | Fishman |
| 4,944,209 | A | 7/1990 | Fishman |
| 4,975,616 | A | 12/1990 | Park |

(Continued)

FOREIGN PATENT DOCUMENTS

| | | | |
|---|---|---|---|
| DE | 3100326 | C2 | 8/1982 |

(Continued)

*Primary Examiner*—Jeffrey W Donels
(74) *Attorney, Agent, or Firm*—Christie, Parker & Hale, LLP

(57) ABSTRACT

An undersaddle pickup for a musical instrument. The undersaddle pickup is constructed from a layer of sensor material or sensor element coupled at a first surface to an electrode. A second electrode is created by coupling a second surface of the sensor material or sensor element to a conductive overbraid surrounding the undersaddle pickup. Depending upon the way the undersaddle pickup is constructed, one or both of the surfaces of the sensor material or sensor element are capacitively coupled to their respective electrodes. A subassembly of the undersaddle pickup may be conveniently manufactured from a sheet of sensor material and an insulating base having a plurality of electrodes deposited on or attached to the base's surface. A sheet of sensor material may be laminated to the base using an adhesive and individual subassemblies may then be die-cut from the insulating base.

59 Claims, 14 Drawing Sheets

U.S. PATENT DOCUMENTS

| | | | | | |
|---|---|---|---|---|---|
| 5,029,375 | A | | 7/1991 | Fishman | |
| 5,155,285 | A | | 10/1992 | Fishman | |
| 5,189,771 | A | * | 3/1993 | Fishman | 29/25.35 |
| 5,319,153 | A | | 6/1994 | Fishman | |
| 5,463,185 | A | | 10/1995 | Fishman | |
| 5,670,733 | A | | 9/1997 | Fishman | |
| 5,817,966 | A | | 10/1998 | Fishman | |
| 6,822,156 | B1 | * | 11/2004 | Lazarus et al. | 84/731 |
| 2004/0159224 | A1 | * | 8/2004 | Raisanen | 84/730 |

FOREIGN PATENT DOCUMENTS

| | | | |
|---|---|---|---|
| DE | 3402463 | C1 | 1/1984 |
| DE | 3536921 | A1 | 4/1987 |

* cited by examiner

UNDERSADDLE PICKUP FOR STRINGED MUSICAL INSTRUMENT

FIELD OF THE INVENTION

The present invention relates generally to pickups, i.e., transducers, for musical instruments and more particularly to construction of an undersaddle pickup for stringed musical instruments.

BACKGROUND OF THE INVENTION

Pickups for stringed musical instruments are well known. One common example of such a pickup is the transducer of an electric guitar, which converts movement, i.e., vibration, of the guitar strings into electrical signals which may be amplified and/or otherwise modified so as to provide the desired volume and/or sound effects.

An example of such a pickup is disclosed in U.S. Pat. No. 5,866,835, issued on Feb. 2, 1999, to Baggs, the contents of which are hereby expressly incorporated by reference. The pickup disclosed in U.S. Pat. No. 5,866,835 is primarily intended to be used in an acoustic musical instrument, such as an acoustic guitar, so as to facilitate amplification and/or modification of the sound produced thereby in a manner which maintains (does not substantially degrade) the nature of the sound produced by the musical instrument.

It is generally desirable that a pickup not substantially alter the characteristics of the sound produced by a musical instrument. The pickup should have a frequency response which is adequate to facilitate the reliable transformation of mechanical vibrations originating from the musical instrument into electrical signals representative thereof. Thus, the pickup should be capable of transforming fundamental tones, as well as higher frequency overtones associated therewith, into electrical signals without substantially altering the relative amplitudes of each fundamental tone and overtone. Moreover, it is desirable to maintain the integrity of the sound produced by the musical instrument, since the musical instrument was specifically designed and constructed so as to provide a particular desired sound.

Although it is desired to maintain the integrity of the sound produced by the musical instrument during conversion of the mechanical vibrations into an electrical signal representative thereof, it is generally desired that this electrical signal be amplified or otherwise modified so as to produce a desired sound. Generally, the signal will be amplified so as to provide a volume which is suitable for a particular venue. As those skilled in the art will appreciate, greater volume may be required in larger venues, as well as in those venues having an abundance of sound absorbing materials, such as drapes, chair cushions and the like.

As discussed in U.S. Pat. No. 5,866,835, a pickup disclosed therein is disposed within a saddle slot formed in a bridge plate of a guitar, such that a saddle bears down upon the pickup. Thus, as the strings of the musical instrument vibrate, their vibrations are transmitted through the saddle to the pickup. The pickup is acted upon by compressive or bending forces generated because of vibrations from the strings and/or sound board. The pickup utilizes piezoelectric principles or the like to convert the vibrations from the string into electrical signals which may be amplified and/or modified so as to produce the desired sound.

Although the pickup disclosed in U.S. Pat. No. 5,866,835 is generally suitable for providing an electrical output representative of the vibration of the strings and/or of the sound board of a musical instrument, this pickup does include plurality of layers which contribute to the complexity and overall cost thereof.

In view of the foregoing, it is desirable to provide a pickup for stringed instruments and the like which is comparatively simple in construction, so as to mitigate both the materials cost and the assembly cost associated therewith.

SUMMARY OF THE INVENTION

In one aspect of the invention, the pickup may be manufactured by providing an undersaddle pickup subassembly having an electrode and providing a lead having an inner conductor, a conducting outer layer having an open end through which the inner conductor extends, and an insulating layer between the inner conductor and the conducting outer layer. The central conductor of the lead is attached to the electrode of the subassembly and the subassembly is inserted into the open end of the conducting outer layer, whereby the lead's conducting outer layer surrounds the subassembly.

In another aspect of the invention, the open end of the conducting outer layer is sealed by soldering, by the use of an adhesive, or by crimping.

In another aspect of the invention, a portion of the conducting outer layer surrounding the subassembly is swaged.

In another aspect of the invention, individual subassemblies are formed by providing a plurality of spaced apart electrodes contacting an insulating substrate, attaching a layer of sensor material to the spaced apart electrodes with a pressure sensitive adhesive, and then cutting out individual subassemblies by cutting the insulating base between the electrodes.

In another aspect of the invention, a subassembly of the undersaddle pickup may be conveniently manufactured from a sheet of sensor material and an insulating base having a plurality of electrodes deposited on or attached to the base's surface. A sheet of sensor material may then be laminated to the base using an adhesive and individual subassemblies are die-cut from the insulating base. Each separated subassembly is attached to a central conductor of a coaxial cable having shielding in the form of an overbraid. The subassembly is then inserted into the overbraid to complete the undersaddle pickup.

In another aspect of the invention, an undersaddle pickup for a musical instrument is constructed from a layer of sensor material coupled at a first surface to an electrode. A second electrode is created by coupling a second surface of the sensor material to a conductive overbraid surrounding the undersaddle pickup. Depending upon the way the undersaddle pickup is constructed, one or both of the surfaces of the sensor material are capacitively coupled to their respective electrodes.

In another aspect of the invention, a pickup for a stringed musical instrument includes a subassembly having an insulating base having a central portion and a peripheral portion with an electrode covering the central portion of the base. A layer of sensor material covers the electrode and the peripheral portion of the base. The subassembly is then covered by an outer conductor.

In another aspect of the invention, the subassembly further includes an insulating layer between the sensor material and the electrode. In another aspect of the invention, the insulating layer between the sensor material and the electrode is an adhesive used to adhere the sensor material to the electrode and the peripheral portion of the base.

In another aspect of the invention, the undersaddle pickup subassembly includes sensor elements having sensor element electrodes. The use of sensor element electrodes allows the sensor element to be in electrical contact with either the central electrode, the surrounding conductive outer layer, or both.

BRIEF DESCRIPTION OF THE DRAWINGS

These and other features, aspects and advantages of the present invention will be more fully understood when considered with respect to the following detailed description, appended claims, and accompanying drawings, wherein:

DETAILED DESCRIPTION

Figure 1:
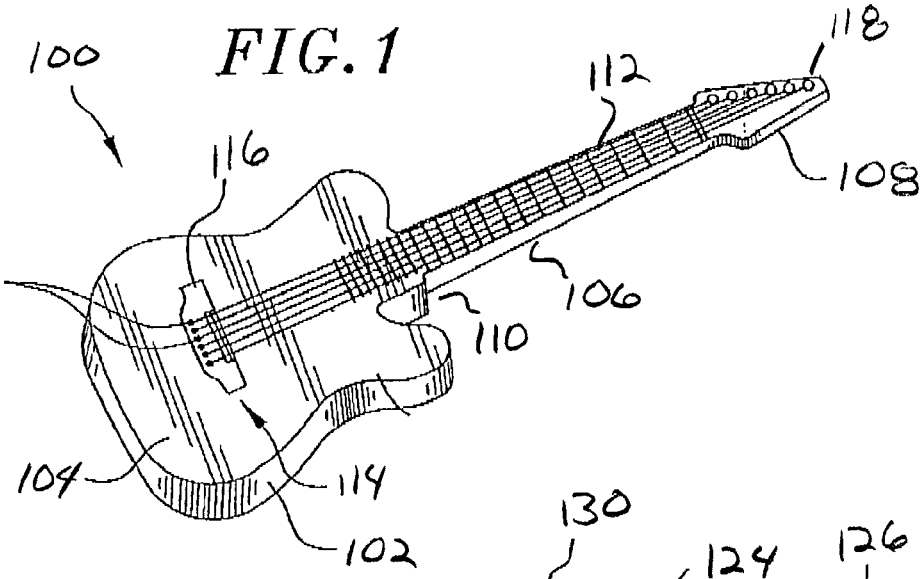
FIG. 1 is a semi-schematic perspective view of a stringed musical instrument.

FIG. 1 is a semi-schematic perspective view of a stringed musical instrument, such as a guitar. A musical instrument 100, such as a guitar, includes body 102 having a sound board or top portion 104. The musical instrument further includes a neck 106 having a head 108 at a first end and a heel 110 at a second end. The neck is fixedly coupled to the body by the heel. One or more strings 112 are each removably coupled to the outer surface of the top portion of the body by a saddle 114 and bridge assembly 116 at a first end portion of each string. Each string is also removably coupled to the head by winding a second end portion of each string around a tuning peg 118 located on the head. The tension of the each string is adjusted using the tuning peg so that plucking a string causes the string to vibrate. As the string vibrates, vibrational energy from the string is transferred to the saddle and bridge assembly and then to the sound board of the body causing the sound board to vibrate in unison with the plucked string.

Figure 2:
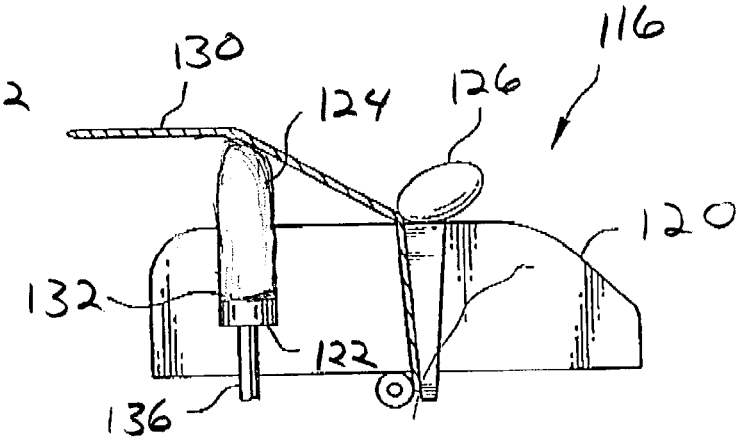
FIG. 2 is a semi-schematic side view of a bridge assembly of the stringed musical instrument of FIG. 1, having a prior art pickup installed within the bridge plate.

FIG. 2 is a semi-schematic side view of a bridge assembly of the stringed musical instrument of FIG. 1, having a prior art undersaddle pickup installed within a bridge plate. A bridge assembly 116 includes a bridge plate 120 having a saddle slot 122 formed therein. The saddle slot receives a lowermost portion of a saddle 124. String retaining posts 126 anchor each string, such as string 130, to the bridge assembly at a first end portion of each string.

A prior art undersaddle pickup 132 is disposed within the saddle slot of the bridge plate such that tension applied by the strings urges the saddle compressively against the prior art undersaddle pickup. Thus, vibrations of the strings of the guitar are mechanically transferred through the saddle to the prior art undersaddle pickup, which then converts the mechanical vibrations into electrical signals suitable for amplification. The electric signals are communicated from the prior art undersaddle pickup via a pair of leads 136.

Such prior art undersaddle pickups posses disadvantages which detract from their desirability as musical instrument pickups. For example, such prior art undersaddle pickups may be undesirably expensive to manufacture, because of the materials costs and assembly cost associated therewith, as discussed above.

Figure 3A:
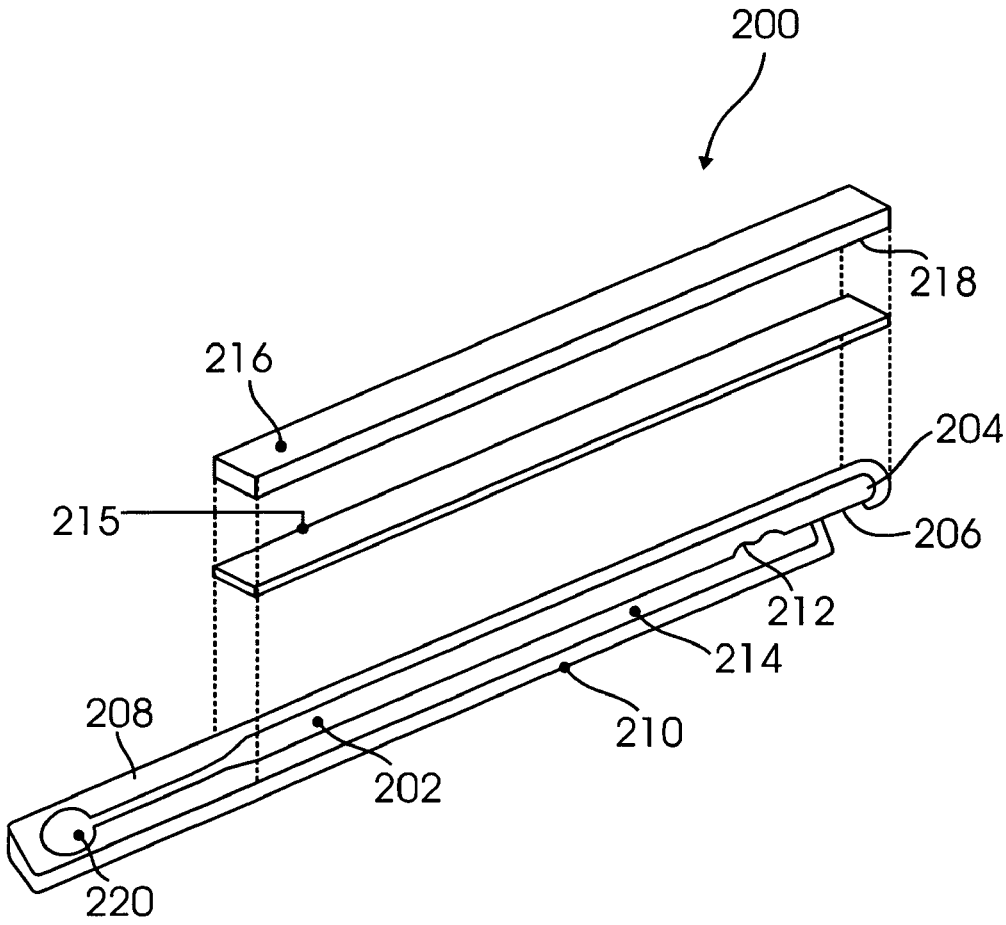
FIG. 3*a* is an semi-schematic exploded view of an undersaddle pickup subassembly employing a film sensor material in accordance with an exemplary embodiment of the present invention.

FIG. 3*a* is a semi-schematic exploded view of an undersaddle pickup subassembly employing sensor material in accordance with an exemplary embodiment of the present invention. An undersaddle pickup subassembly 200 includes a flattened elongated electrode 202 having a top surface 204 and a bottom surface 206 as illustrated through a cutaway portion of an insulating base 210. The electrode is composed of a conductive material such as copper. The electrode contacts a top surface 208 of the insulating base at the electrodes bottom surface. The electrode may be placed on the top surface of the base during a manufacturing process or may be fixedly attached the base's top surface. The insulating base may be composed of a flexible insulating material such as a material commercially known as Kapton. The base includes a center portion 212, as illustrated through a cutaway portion of the electrode, under the electrode and a peripheral portion 214 surrounding the electrode whereby the electrode does not fully extend over the top surface of the base. A layer of adhesive 215, such as a pressure sensitive adhesive, adheres a layer of sensor material 216, such as piezoelectrically active homopolymer or copolymer polyvinylidene fluoride (PVDF) material, at a bottom surface 218 of the sensor material to the top surface of the electrode and the peripheral portion of the top surface of the base. The adhesive layer and sensor material layer extend to, but do not cover, a contact portion 220 of the electrode.

In one undersaddle pickup subassembly in accordance with an exemplary embodiment of the present invention, the electrode extends over the peripheral portion of the base.

In one undersaddle pickup subassembly in accordance with an exemplary embodiment of the present invention, the electrode is an elongated strip of copper 0.040 inches wide by three and one-half inches long with the contact portion extending another one-half inch. The insulating base underlying the electrode is 0.070 inches wide by about four inches long is approximately 0.008 inches thick. The sensor material overlying the electrode is approximately 0.00011 inches thick.

In one undersaddle pickup subassembly in accordance with an exemplary embodiment of the present invention, the sensor material includes electrodes either deposited or printed onto the sensor material's top surface, or the sensor material's bottom surface, or both.

Figure 3B:
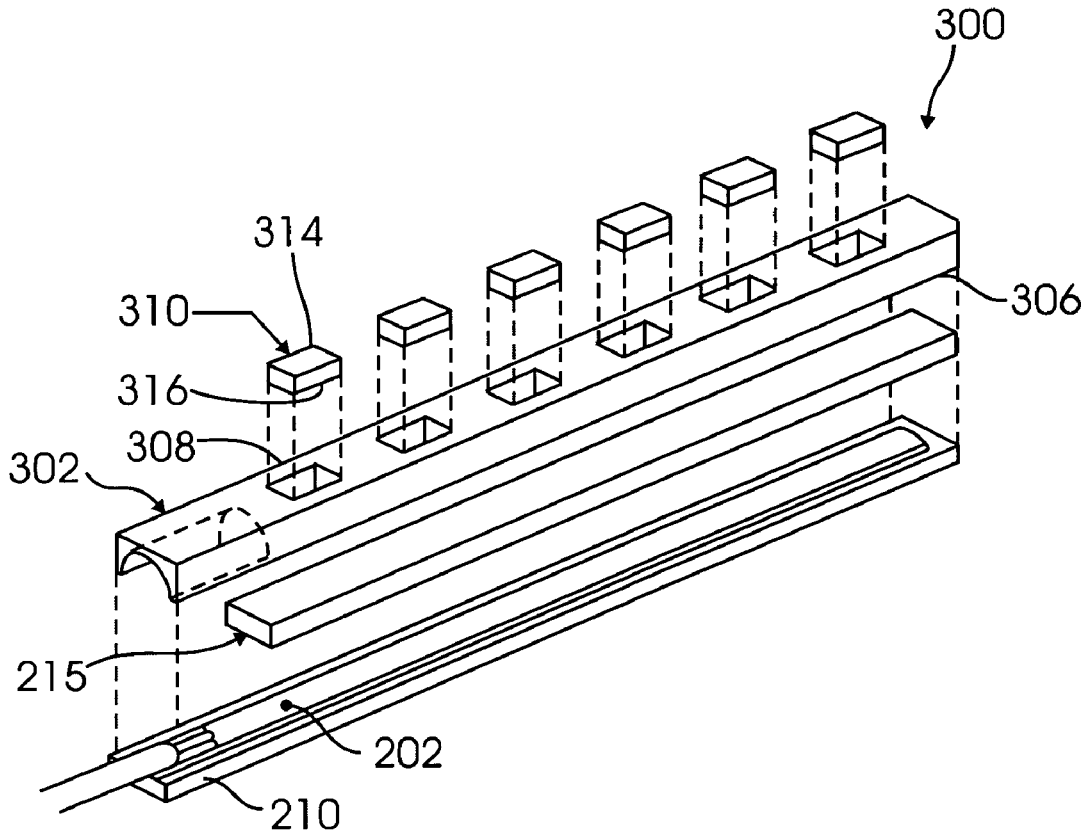
FIG. 3*b* is a semi-schematic exploded view of an undersaddle pickup subassembly employing sensor elements in accordance with an exemplary embodiment of the present invention.

FIG. 3*b* is a semi-schematic exploded view of an undersaddle pickup subassembly employing sensor elements in accordance with an exemplary embodiment of the present invention. In an undersaddle pickup subassembly employing sensor elements 300, the function of the sensor material of the undersaddle pickup subassembly illustrated in FIG. 3*a* is performed by a plurality of individual sensor elements or discrete sensors. In this configuration, the undersaddle pickup subassembly includes a flattened elongated electrode 202 and an insulating base 210 as previously described. In addition, the undersaddle pickup subassembly includes an insulating sensor element holder or tray 302 having a top surface 304 and a bottom surface 306 including a plurality of openings or wells, such as well 308, extending through the tray from the tray's top surface to the tray's bottom surface. A plurality of individual sensor elements, such as sensor element 310, are placed into the plurality of wells such that lateral movement of the sensor elements is restricted. The tray is adhered to the insulating base and the electrode by a layer of adhesive 215. As constructed, the plurality of sensor elements extend through the thickness of the tray exposing a sensor element top surface, such as top surface 314, and a sensor element bottom surface, such as bottom surface 316, for each sensor element, thus each sensor elements' top surface and bottom surface are exposed for coupling to external electrical circuits.

In one undersaddle pickup subassembly employing sensor elements in accordance with an exemplary embodiment of the present invention, the sensor elements are composed of a piezoelectrically active ceramic material. Other types of sensor elements may be used as well, for example, sensor elements that must be excited by an external current or voltage source, such as electret pickups, may be used with the necessary excitation circuitry routed through the tray.

In one undersaddle pickup subassembly employing sensor elements in accordance with an exemplary embodiment of the present invention, the number of sensor elements and relative positioning of the sensor elements correspond to the number of strings employed by the stringed musical instrument. For example, an undersaddle pickup subassembly intended for an undersaddle pickup for a conventional guitar may have six sensor elements more or less evenly spaced along a length of the tray.

In one undersaddle pickup subassembly employing sensor elements in accordance with an exemplary embodiment of the present invention, the tray is composed of a flexible insulating material such as polyethylene.

In another undersaddle pickup subassembly employing sensor elements in accordance with an exemplary embodiment of the present invention, the wells do not extend completely though the tray from the tray's top surface to the tray's bottom surface. In this embodiment, the wells have either a bottom surface or a top surface and the sensor elements have only one exposed surface. In another tray embodiment, the sensor elements are completely encapsulated by the tray with no exposed surfaces.

In another undersaddle pickup subassembly employing sensor elements in accordance with an exemplary embodiment of the present invention, the pickup subassembly is constructed without an adhesive layer. In this case, the sensor elements and the tray are in intimate contact with any coupled electrodes or circuitry.

In another undersaddle pickup subassembly employing sensor elements in accordance with an exemplary embodiment of the present invention, the sensor elements include electrodes deposited or printed on to their top and bottom surfaces.

In various undersaddle pickup subassemblies constructed in accordance with the present invention, the sensor material or sensor elements may include sensor electrodes affixed to one or more surfaces. In one construction technique, an electrode is created on a surface of the sensor material or sensor element by vacuum depositing a layer of conductive material on the surface. In another construction technique, an electrode is created using conductive inks printed or silk screened onto the surface. Whether or not the sensor material or sensor element has sensor electrodes affects how an electrical signal generated by the sensor material or sensor element is coupled to an amplification circuit.

Figure 3C:
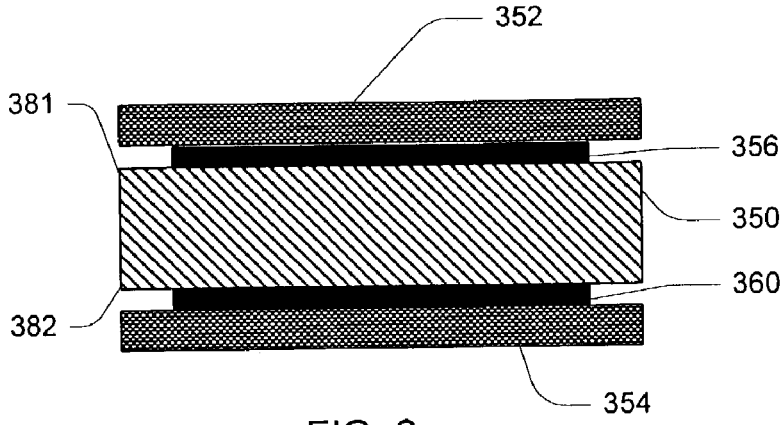
FIG. 3*c* is a semi-schematic cross section of an undersaddle pickup subassembly with sensor material or a sensor element having sensor electrodes in accordance with an exemplary embodiment of the present invention.

FIG. 3*c* is a semi-schematic cross section of an undersaddle pickup subassembly with sensor material or a sensor element having sensor electrodes in accordance with an exemplary embodiment of the present invention. In the semi-schematic cross section, the thicknesses of the illustrated materials are not to scale as the semi-schematic cross section is for illustrative purposes only. In this undersaddle pickup subassembly, a sensor material or sensor element 350 has a first sensor electrode 356 affixed to a first surface 381 of the sensor material or sensor element. The first sensor electrode is coupled to a first external electrode 352 by mechanical contact. The sensor material or sensor element 350 has a second sensor electrode 360 affixed to a second surface 382 of the sensor material or sensor element. The second sensor electrode is coupled to the second external electrode 354 by mechanical contact. As the sensor material or sensor element has sensor electrodes affixed to its surfaces, the clamped mechanical contact results in an electrically conductive coupling between the sensor material or sensor element and the external electrodes.

Figure 3D:
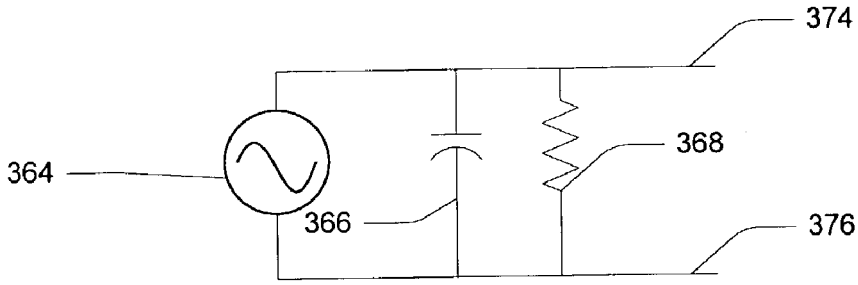
FIG. 3*d* is a circuit diagram of an equivalent circuit for the undersaddle pickup subassemblies of FIG. 3*c* and FIG. 3*e;*

FIG. 3*d* is a circuit diagram of an equivalent circuit for the undersaddle pickup subassembly of FIG. 3*c*. In this circuit, the sensor material or sensor element may be modeled as an alternating current charge generating source 364. The equivalent circuit further includes a capacitor 366 representing the internal capacitance of the sensor material or sensor element, and a resistor 368 representing the internal resistance of the sensor material or sensor element. An amplification circuit may be electrically coupled to the undersaddle pickup subassembly using leads 374 and 376.

Figure 3E:
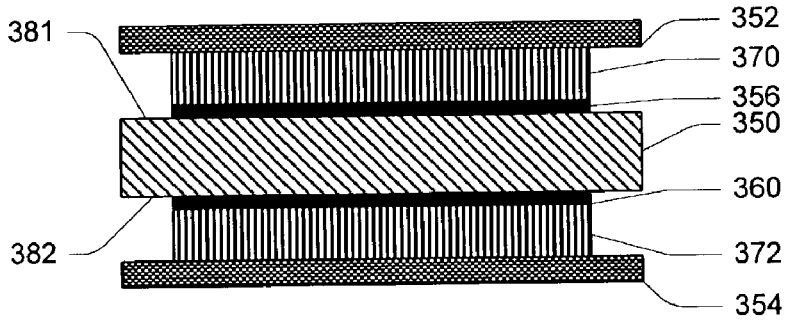
FIG. 3*e* is a semi-schematic cross section of an undersaddle pickup subassembly with sensor material or a sensor element having sensor electrodes and conductive adhesive in accordance with an exemplary embodiment of the present invention.

FIG. 3*e* is a semi-schematic cross section of an undersaddle pickup subassembly with sensor material or a sensor element having sensor electrodes and conductive adhesive in accordance with an exemplary embodiment of the present invention. In the semi-schematic cross section, the thicknesses of the illustrated materials are not to scale as the semi-schematic cross section is for illustrative purposes only. Sensor material or a sensor element 350 has a first sensor electrode 356 affixed to a first surface 381 of the sensor material or sensor element. The first sensor electrode may be mechanically and electrically coupled to the first external electrode 352 using a conductive adhesive material 370. The sensor material or sensor element 350 also includes a second sensor electrode 360 affixed to a second surface 382 of the sensor material or sensor element. The second sensor electrode is electrically and mechanically coupled to the second external electrode 354 using a conductive adhesive material 372. As the adhesive material is also a conductor, the resulting undersaddle pickup subassembly may be modeled by the equivalent circuit of FIG. 3*d*.

Figure 3F:
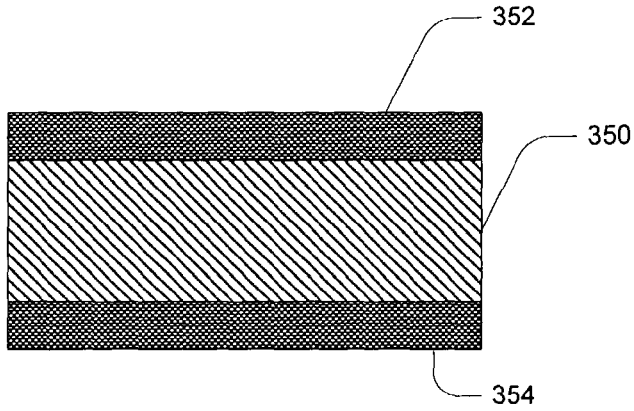
FIG. 3*f* is a semi-schematic cross section of an undersaddle pickup subassembly having sensor material or a sensor element coupled to external electrodes in accordance with an exemplary embodiment of the present invention.

FIG. 3*f* is a semi-schematic cross section of an undersaddle pickup subassembly having sensor material or a sensor element coupled to external electrodes in accordance with an exemplary embodiment of the present invention. In the semi-schematic cross section, the thicknesses of the illustrated materials are not to scale as the semi-schematic cross section is for illustrative purposes only. Sensor material or a sensor element 350 is coupled to a first external electrode 352 and a second external electrode 354 through mechanical contact. As the surfaces of the sensor material or sensor element have poor conductivity, the clamped mechanical contact does not result in an electrically conductive coupling. Instead, the sensor material or sensor element is capacitively coupled to the external electrodes.

Figure 3G:
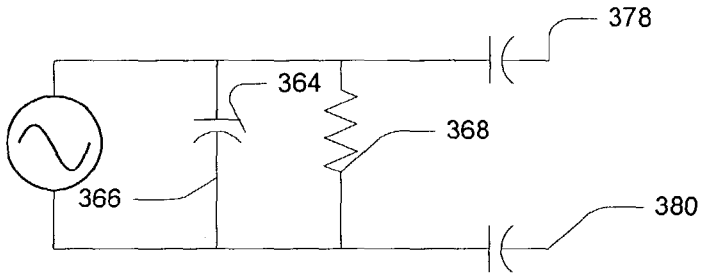
FIG. 3*g* is a circuit diagram of an equivalent circuit for the undersaddle pickup subassembly of FIG. 3*f;*

FIG. 3*g* is a circuit diagram of an equivalent circuit for the undersaddle pickup subassembly of FIG. 3*f*. In this circuit, the sensor material or sensor element is modeled as an alternating current charge generating source 364. The equivalent circuit further includes a capacitor 366 representing the internal capacitance of the sensor material or sensor element, and a resistor 368 representing the internal resistance of the sensor material or sensor element. However, in contrast to the undersaddle pickup subassembly circuit of FIG. 3*d*, the sensor material or sensor element is isolated from an amplification circuit by capacitors 378 and 380. Thus, an amplification circuit may be capacitively coupled to the undersaddle pickup subassembly.

Figure 3H:
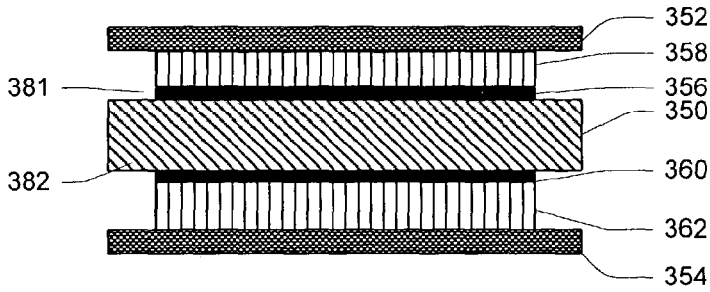
FIG. 3*h* is a semi-schematic cross section of an undersaddle pickup subassembly having sensor material or a sensor element with sensor electrodes and insulating layers in accordance with an exemplary embodiment of the present invention.

FIG. 3*h* is a semi-schematic cross section of an undersaddle pickup subassembly having sensor material or a sensor element with sensor electrodes and insulating layers in accordance with an exemplary embodiment of the present invention. In the semi-schematic cross section, the thicknesses of the illustrated materials are not to scale as the semi-schematic cross section is for illustrative purposes only. Sensor material or a sensor element 350 has a first sensor electrode 356 affixed to a first surface 381 of the sensor material or sensor element. The first sensor electrode is mechanically coupled to the first external electrode 352 using an adhesive material 358. The sensor material or sensor element 350 also has a second sensor electrode 360 affixed to a second surface 382 of the sensor material or sensor element. The second sensor electrode may be mechanically coupled to a second external electrode 354 using an adhesive material 362. If the adhesive material is an insulating material, the resulting undersaddle pickup subassembly may be modeled by the equivalent circuit of FIG. 3*g*.

Figure 3I:
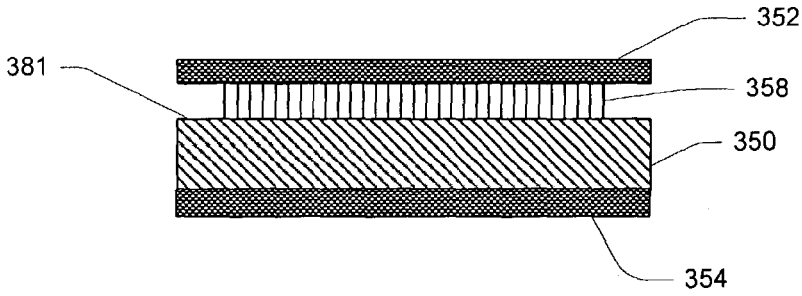
FIG. 3*i* is a semi-schematic cross section of an undersaddle pickup subassembly having sensor material or a sensor element with an insulating layer in accordance with an exemplary embodiment of the present invention.

FIG. 3*i* is a semi-schematic cross section of an undersaddle pickup subassembly having sensor material or a sensor element with an insulating layer in accordance with an exemplary embodiment of the present invention. In the semi-schematic cross section, the thicknesses of the illustrated materials are not to scale as the semi-schematic cross section is for illustrative purposes only. A first surface 381 of a sensor material or sensor element 350 is mechanically coupled to the first external electrode 352 using an adhesive material 358. The sensor material or a sensor element is further coupled to a second external electrode 354 through mechanical contact. If the adhesive material is an insulating material, the resulting undersaddle pickup subassembly may be modeled by the equivalent circuit of FIG. 3*g*.

Figure 3J:
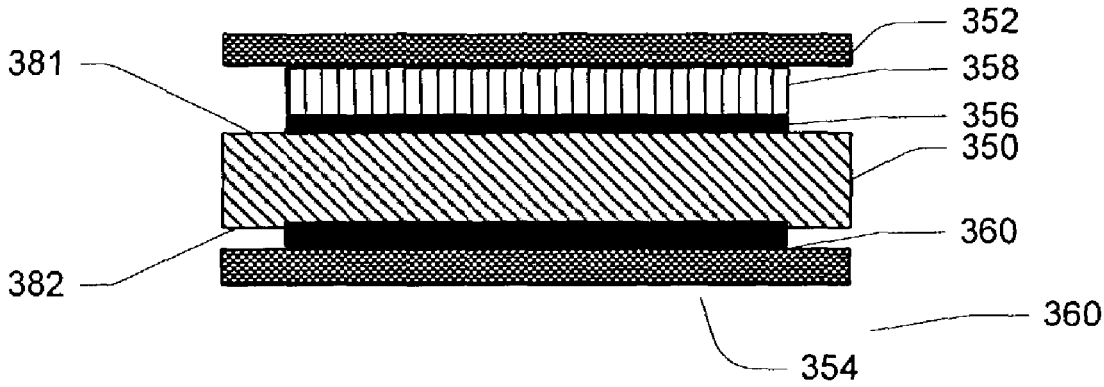
FIG. 3*j* is a semi-schematic cross section of an undersaddle pickup subassembly having sensor material or a sensor element with sensor electrodes.

FIG. 3*j* is a semi-schematic cross section of an undersaddle pickup subassembly having sensor material or a sensor element with sensor electrodes. The undersaddle pickup subassembly includes an insulating layer adjacent to one surface. In the semi-schematic cross section, the thicknesses of the illustrated materials are not to scale as the semi-schematic cross section is for illustrative purposes only. Sensor material or a sensor element 350 has a first sensor electrode 356 affixed to a first surface 381 of the sensor material or sensor element. The first sensor electrode is mechanically coupled to the first external electrode 352 using an adhesive material 358. The sensor material or sensor element 350 also has a second sensor electrode 360 affixed to a second surface 382 of the sensor material or sensor element. The second sensor electrode may be coupled to a second external electrode 354. In this case, the use of the insulating adhesive between the first sensor electrode and the first external electrode creates a capacitive coupling between the first sensor electrode and the first external electrode. However, as the second sensor electrode is directly coupled to the second external electrode, the second sensor electrode is electrically coupled to the second external electrode. Various undersaddle pickup subassemblies sharing the same equivalent circuit representation may be assembled by combining features of the sensor subassemblies of FIG. 3*c*, FIG. 3*e*, FIG. 3*f*, and FIG. 3*h*.

Figure 3K:
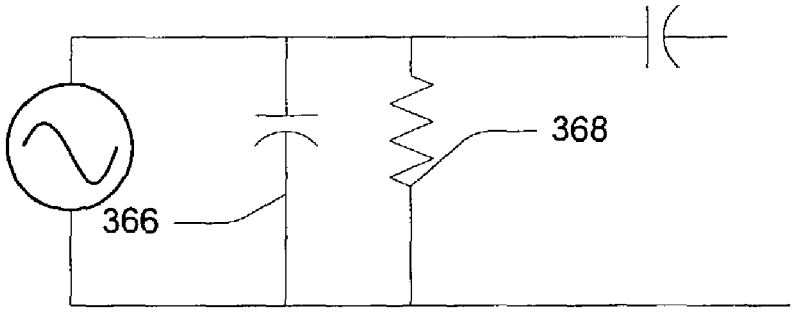
FIG. 3*k* is a circuit diagram of an equivalent circuit for the undersaddle pickup subassembly of FIG. 3*i;*

FIG. 3*k* is a circuit diagram of an equivalent circuit for the undersaddle pickup subassembly of FIG. 3*i*. The equivalent circuit includes an alternating current charge generating source 364 representing the sensor material or sensor element. The equivalent circuit further includes capacitor 366 and resistor 368 representing the internal capacitance and resistance of the sensor material or sensor element respectively. As one surface of the sensor material or sensor element in the undersaddle pickup subassembly of FIG. 3*i* is capacitively coupled to the surface's corresponding external electrode, the equivalent circuit includes capacitor 378 at the termination of one lead.

Figure 4:
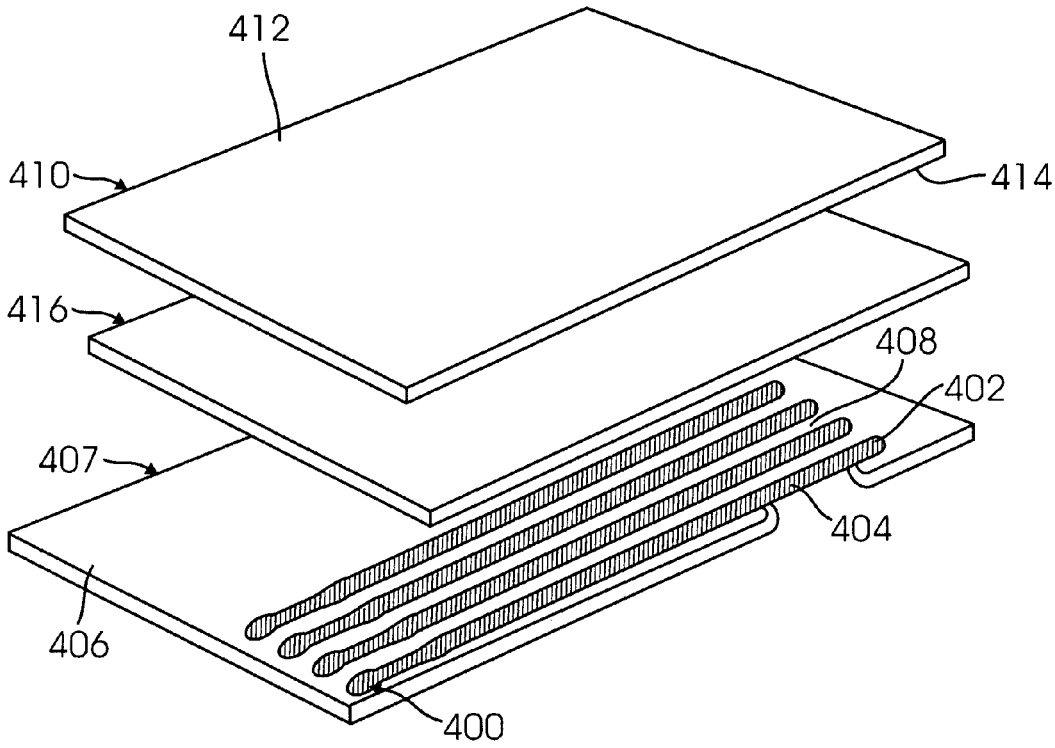
FIG. 4 is a diagram depicting a die-cut manufacturing process used to manufacture a plurality of undersaddle pickup subassemblies in accordance with an exemplary embodiment of the present invention.

FIG. 4 is a diagram depicting a die-cut manufacturing process used to manufacture a plurality of undersaddle pickup subassemblies in accordance with an exemplary embodiment of the present invention. In the manufacturing process, a plurality of spaced apart conducting electrodes 400, each having a top surface, such as top surface 402, and a bottom surface 404 placed on or are attached to a top surface 406 of a flexible insulating base 406 at the electrode's bottom surfaces. As the electrodes are spaced apart on the top surface of the base, there is a portion of the top surface 408 where the top surface of the base is exposed. A layer of sensor material film 410 having a top surface 412 and a bottom surface 414 is attached at its bottom surface to the top surfaces of the electrodes and the exposed portions of the top surface of the base using an adhesive material 416. The laminated assembly may then be die-cut to produce individual undersaddle pickup subassemblies as described in FIG. 3.

In another die-cut manufacturing process used to manufacture a plurality of undersaddle pickup subassemblies in accordance with an exemplary embodiment of the present invention, the electrodes are not formed by spaced-apart electrodes on the top surface of the base. Instead, a layer of conductive electrode material is placed on the base creating a layered structure. The separated electrodes are then formed during the die-cutting process.

Figure 5:
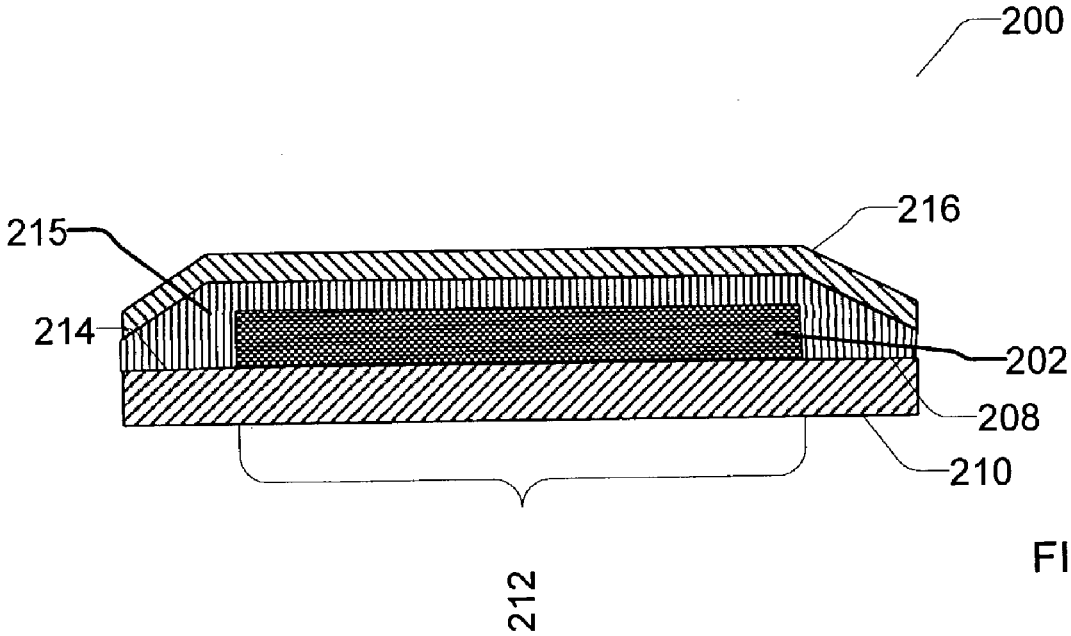
FIG. 5 is semi-schematic cross-sectional drawing of an undersaddle pickup sub-assembly created from an insulating base, electrode, adhesive, and sensor material in accordance with an exemplary embodiment of the present invention.

FIG. 5 is semi-schematic cross-sectional drawing of an undersaddle pickup subassembly created from an insulating base, electrode, adhesive, and sensor material in accordance with an exemplary embodiment of the present invention. In an undersaddle pickup subassembly 200, an electrode 202 contacts and is supported by an insulating base 210. The electrode overlies a center portion 212 of a top surface 208 of the base leaving a peripheral portion 214 of the top surface surrounding the electrode whereby the electrode does not fully extend over the top surface of the base. A layer of sensor material 216 is adhered to a top surface of the electrode 204 and the peripheral portion of the top surface of the base by an adhesive layer 215.

Figure 6A:
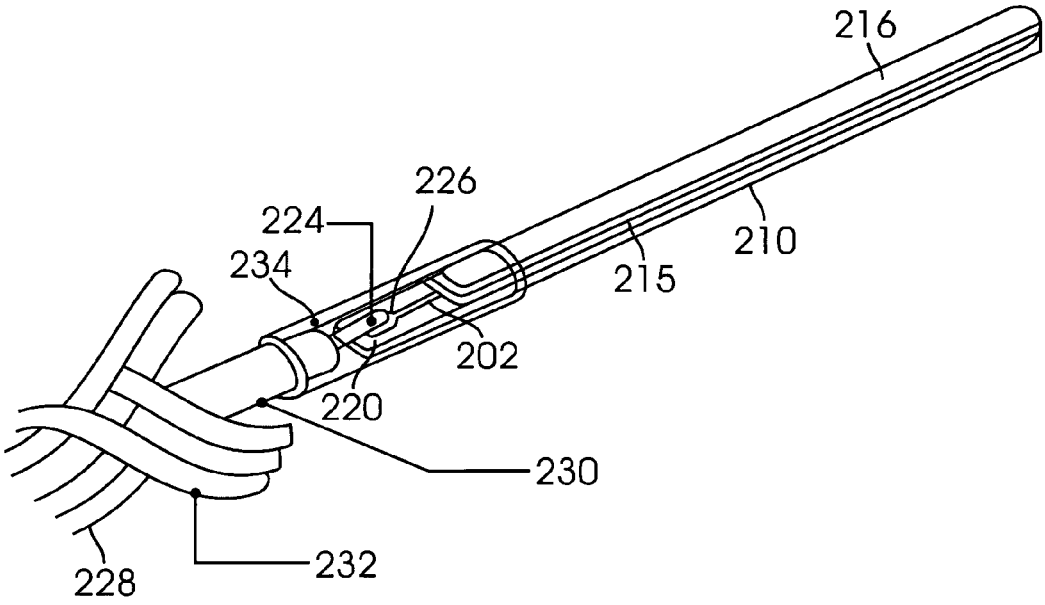
FIG. 6*a* is a semi-schematic perspective drawing of a sub-assembly of an undersaddle pickup coupled to an electrical lead in accordance with an exemplary embodiment of the present invention.

FIG. 6*a* is a semi-schematic perspective drawing of a sub-assembly of an undersaddle pickup coupled to an electrical lead in accordance with an exemplary embodiment of the present invention. An electrical lead 224 is electrically coupled, such as by soldering, to the electrode 202 at a contact portion 220 of the electrode having a solder pad 226. The lead is a central conductor in a coaxial cable 228 having insulating sheathing 230 surrounding the central conductor. A suitable coaxial cable is commercially available from Whitmore Wirenetics Co. as model number RG 178. The insulating sheathing is surrounded by a conductive layer 232 such as a conductive overbraid. As illustrated, the undersaddle pickup subassembly is in its assembled configuration with a layer of sensor material 216 adhered to the top surface of the electrode and a peripheral portion of the top surface of the base 210 by a layer of adhesive 215. The contact portion, with the attached lead, is covered by a contact insulating layer 234 such as shrink wrap tubing that surrounds the contact portion of the electrode, the portion of the lead attached to the contact portion of the electrode, and the portion of the base underlying the contact portion of the electrode. The contact portion insulating layer extends over and covers a portion of the insulating sheathing and extends to, and may partially cover, the sensor material layer of the undersaddle pickup subassembly.

Final assembly of the undersaddle pickup is achieved by withdrawing the undersaddle pickup subassembly into the conductive layer of the coaxial cable such that the conductive layer extends over and surrounds the undersaddle pickup subassembly. An end portion of the conductive layer is then sealed by soldering the end closed. The end may also be sealed with the use of an adhesive or by mechanical means such as crimping or swaging. The completed undersaddle pickup may then be reformed to have a specified cross section such as rounded or rectangular as may be required to conform to a saddle slot.

In one undersaddle pickup in accordance with an exemplary embodiment of the present invention, the contact insulating layer is extended until it covers the sensor material. This results in the sensor material being insulated on its top surface.

In another undersaddle pickup in accordance with an exemplary embodiment of the present invention, the sensor material layer is coupled to the electrode by placing the sensor material layer on the electrode without an intervening adhesive layer. In this embodiment, the contact insulating layer is extended until it covers the sensor material. If the contact insulating layer is formed from shrink-wrap tubing surrounding the sensor material, electrode, and base, then the contact insulating layer can serve to hold the sensor material and electrode in intimate contact.

Figure 6B:
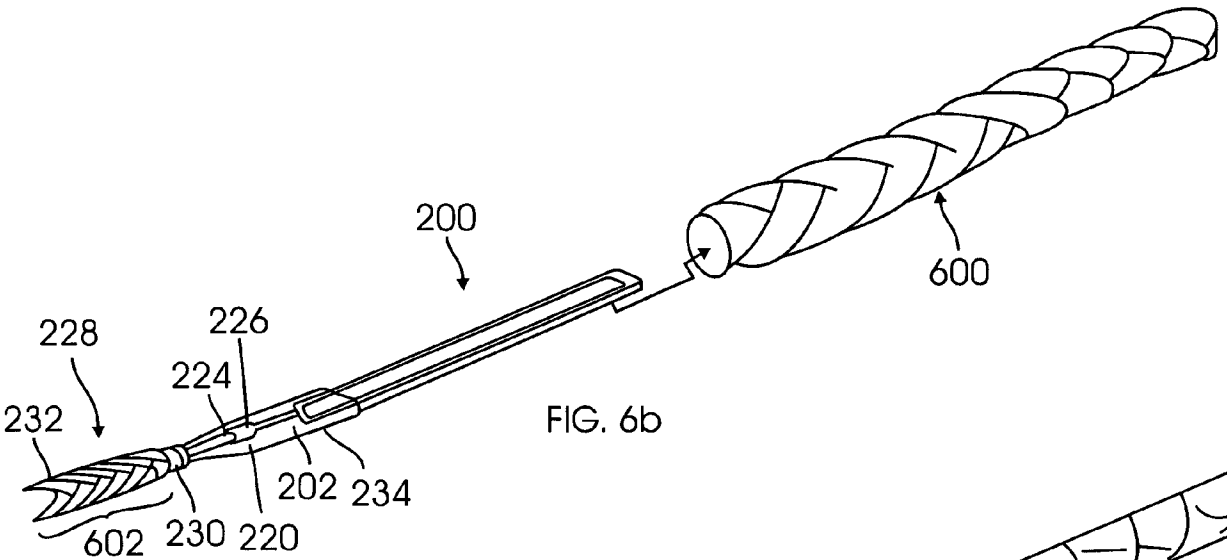
FIG. 6*b* is a semi-schematic perspective exploded view of an undersaddle pickup having a two-part overbraid in accordance with an exemplary embodiment of the present invention.

FIG. 6*b* is a semi-schematic perspective exploded view of an undersaddle pickup having a multipart overbraid in accordance with an exemplary embodiment of the present invention. An undersaddle pickup having a multipart overbraid is assembled in a similar manner as a previously described undersaddle pickup. An electrical lead 224 is electrically coupled, such as by soldering, to an electrode 202 at a contact portion 220 of the electrode having a solder pad 226. The lead is a central conductor in a coaxial cable 228 having insulating sheathing 230 surrounding the central conductor. The insulating sheathing is surrounded by a conductive layer 232 such as a conductive overbraid. The contact portion, with the attached lead, is covered by a contact insulating layer 234 such as shrink wrap tubing that surrounds the contact portion of the electrode, the portion of the lead attached to the contact portion of the electrode, and the portion of the base underlying the contact portion of the electrode. The contact portion insulating layer extends over and covers a portion of the insulating sheathing and extends to, but does not cover, the sensor material layer of the undersaddle pickup subassembly.

Once the lead is soldered to the undersaddle pickup sub-assembly, the undersaddle sub-assembly is inserted in to a section of conductive overbraid 600. The section of conductive overbraid has an internal diameter such that the undersaddle pickup sub-assembly and a portion 602 of the lead including the lead's outer conductive layer 232 may be inserted into the section of conductive overbraid.

Figure 6C:
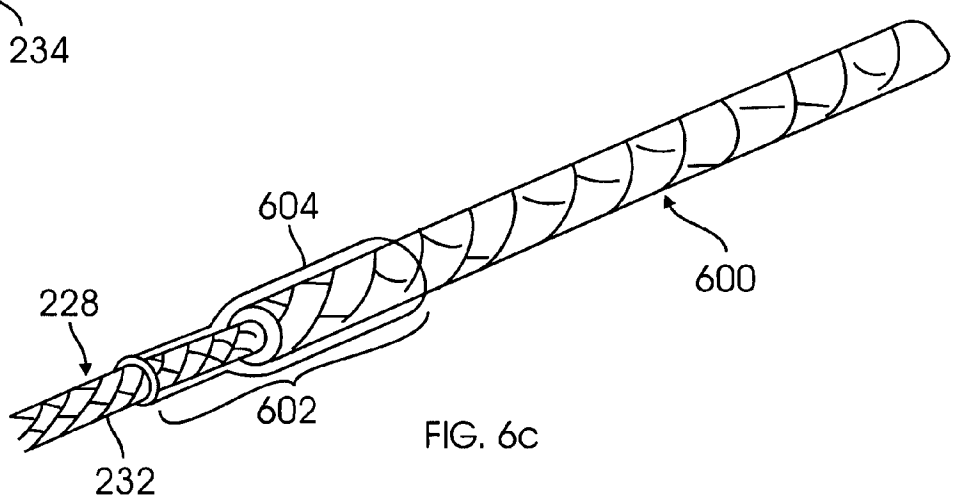
FIG. 6*c* is a semi-schematic perspective drawing of an assembled undersaddle pickup having a two-part overbraid in accordance with an exemplary embodiment of the present invention.

FIG. 6*c* is a semi-schematic perspective drawing of an assembled undersaddle pickup having a multipart overbraid in accordance with an exemplary embodiment of the present invention. Once assembled, the section of overbraid 600 extends over the exterior surface of an undersadlle pickup and over a portion 602 of the lead 228 including the lead's outer conductive layer 232. The section of conductive overbraid is secured to the lead's outer conductive layer by a section of shrink-to-fit tubing 604. The layer by a section of shrink-to-fit tubing not only serves to secure the section of conductive overbraid to the lead's conductive layer, the shrink-to-fit tubing also compresses the section of conductive overbraid so that it is in electrical contact with the lead's conductive layer.

Figure 7:
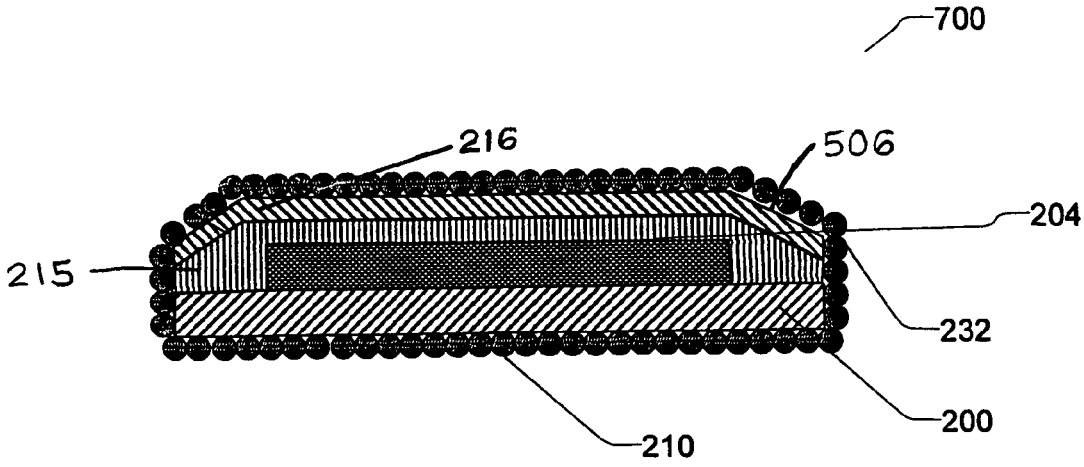
FIG. 7 is a semi-schematic cross-sectional view of an undersaddle pickup in accordance with an exemplary embodiment of the present invention.

FIG. 7 is a semi-schematic cross-sectional view of an undersaddle pickup in accordance with an exemplary embodiment of the present invention. An undersaddle pickup 700 includes an undersaddle pickup subassembly 200 and an outer conductive layer 232, such as a conductive overbraid, surrounding the undersaddle pickup subassembly. A layer of sensor material 216 is adhered to a top surface of the electrode 204 and the peripheral portion of the top surface of the base by an adhesive 215. The conductive outer layer surrounds the entire undersaddle pickup subassembly and is coupled with a top surface 506 of the sensor material layer.

Figure 8:
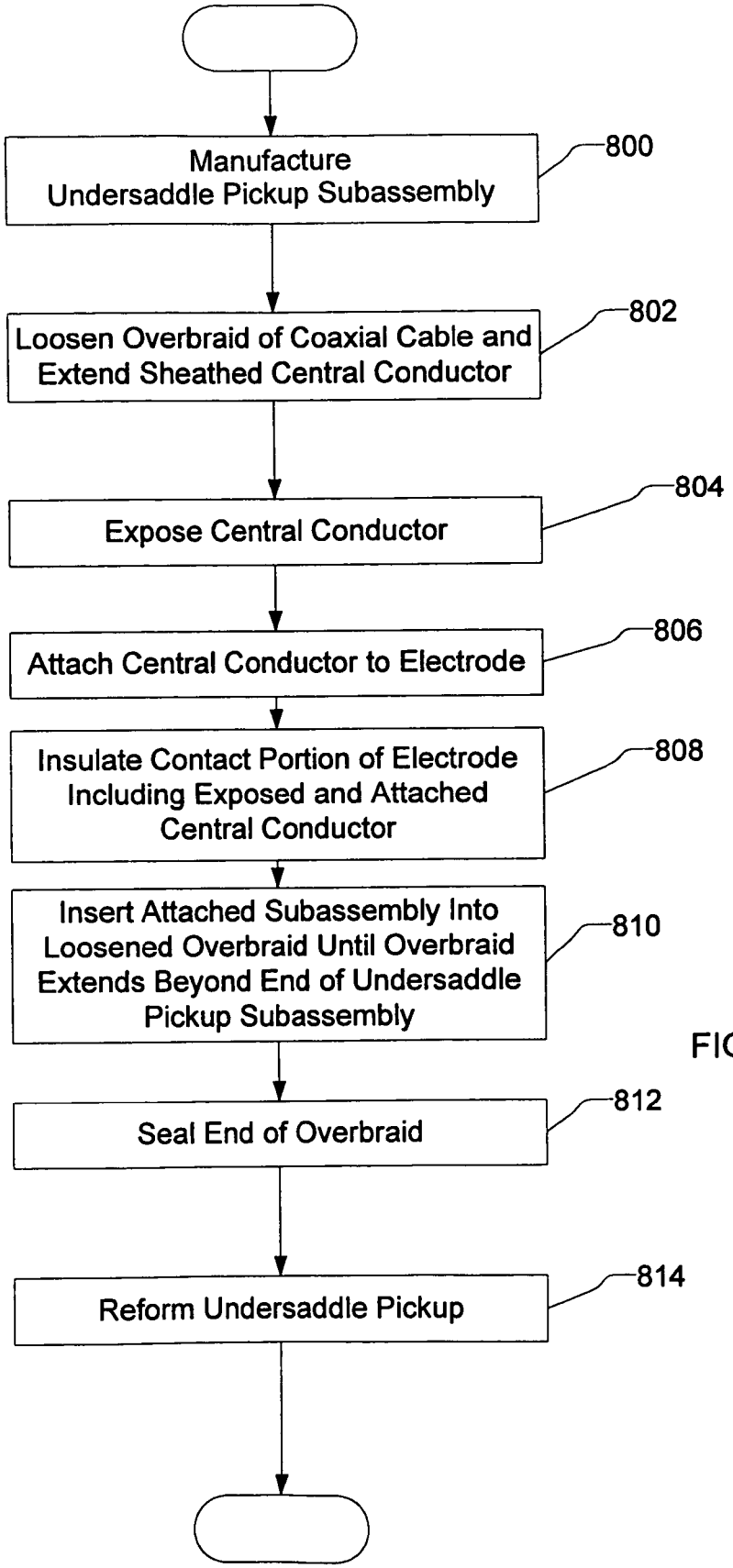
FIG. 8 is a process flow diagram of an undersaddle pickup assembly process in accordance with an exemplary embodiment of the present invention.

FIG. 8 is a process flow diagram of an undersaddle pickup assembly process in accordance with an exemplary embodiment of the present invention. An undersaddle pickup subassembly is manufactured (800) as previously described. The undersaddle pickup subassembly may be assembled singly or may assembled in a die-cut process as previously described. To prepare a coaxial cable having a conductive overbraid for coupling to the undersaddle pickup subassembly, the overbraid is loosened (802) and a portion of a sheathed central conductor is extended from the loosened overbraid. The extended portion of the sheathed central conductor is exposed (804) by removing a portion of the sheathing in order to create a lead for attachment to a contact portion of the electrode of the undersaddle pickup subassembly. The central conductor is attached (806) to the contact portion of the electrode of the undersaddle pickup subassembly and the contact portion is insulated (808). The undersaddle pickup subassembly is then inserted (810) into the loosened overbraid of the coaxial cable such as by pulling on the central conductor so that the undersaddle pickup subassembly is retracted into the loosened overbraid. The undersaddle pickup subassembly is inserted until an end portion of the loosened overbraid extends beyond an end of the undersaddle pickup subassembly. The end portion of he loosened overbraid is sealed (812) such as by soldering the end closed. The end may also be sealed with the use of an adhesive or by mechanical means such as crimping or swaging. The completed undersaddle pickup may then be reformed (814) to have a specified cross section such as rounded or rectangular as may be required to conform to a saddle slot.

Figure 9:
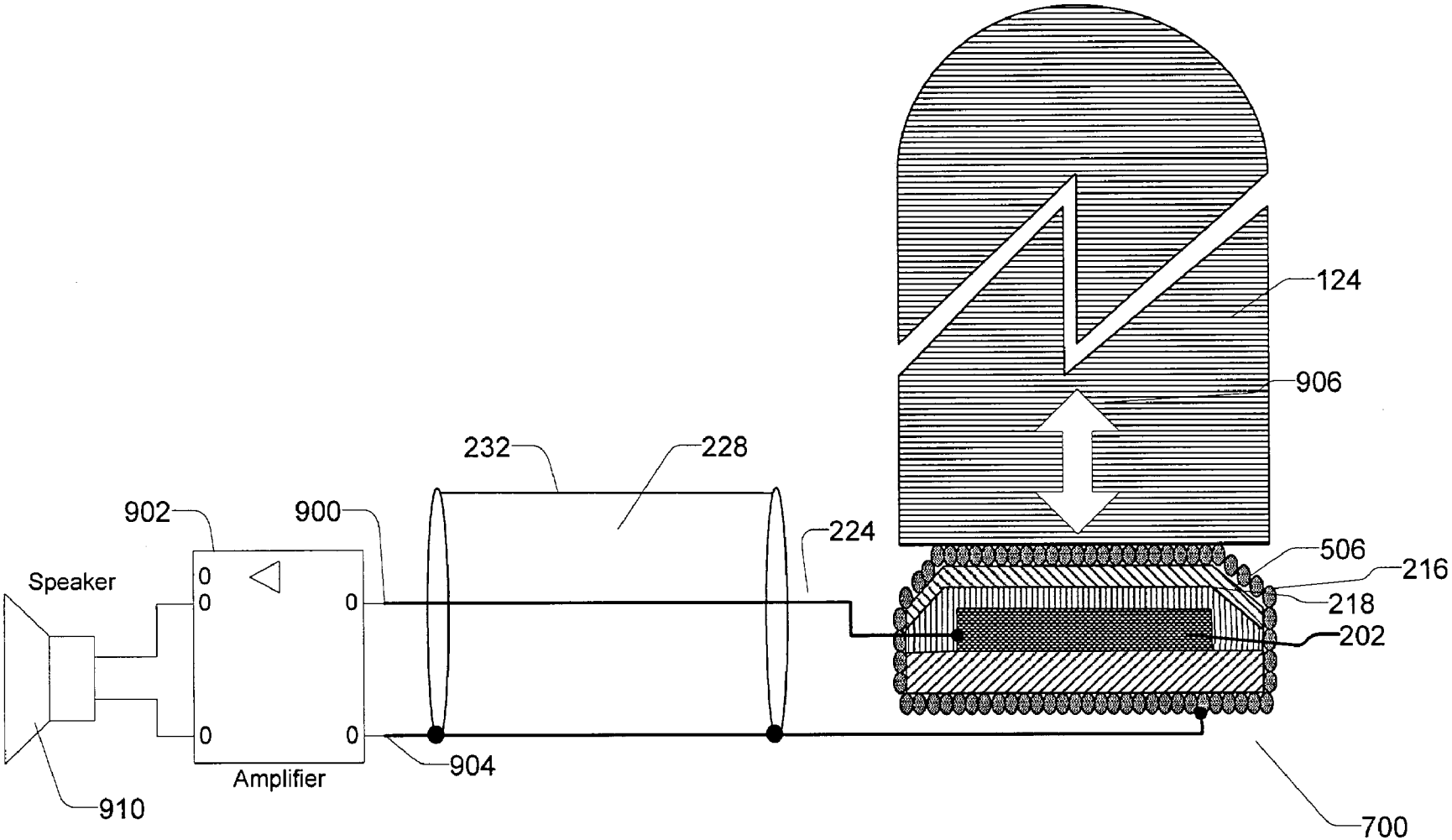
FIG. 9 is a schematic diagram depicting the operation of an undersaddle pickup in accordance with an exemplary embodiment of the present invention.

FIG. 9 is a schematic diagram depicting the operation of an undersaddle pickup in accordance with an exemplary embodiment of the present invention. An electrode 202 of an undersaddle pickup 700 is coupled to a lead 224 that is also the central conductor of a coaxial cable 228 as previously described. The central conductor of the coaxial cable is coupled to a first input 900 of an amplifier 902. An outer conductive layer or overbraid 232 of the coaxial cable is coupled to a top surface 506 of a sensor material layer 216 of the undersaddle pickup as previously described. The overbraid of the coaxial cable is thus coupled as a lead to the top surface of the sensor material layer of the undersaddle pickup and the overbraid is coupled to a second input 904 of the amplifier.

In operation, a saddle 124 is placed in intimate contact with the undersaddle pickup and vibrations 906 induced in the saddle by previously described musical instrument strings are transmitted to the sensor material layer through the conductive overbraid. As the sensor material layer has piezoelectric properties, the vibrations induce an oscillating or alternating current electrical signal at the top surface and a bottom surface 218 of the sensor material layer. Since the top surface of the sensor material layer is coupled with the conductive overbraid, electrical signals induced at the top surface of the sensor material layer are transmitted to the second input of the amplifier. As the bottom surface of the sensor material layer is coupled to the second input of the amplifier. The amplifier receives the coupled signals and generates an amplified signal which may be transmitted to a speaker 910 or another amplifier as desired.

In another undersaddle pickup in accordance with an exemplary embodiment of the present invention, the sensor material may have a sensor electrode affixed on one or more surfaces. In this case, any surface of the sensor material having an affixed sensor electrode will be electrically coupled to an input of the amplifier.

In another undersaddle pickup in accordance with an exemplary embodiment of the present invention, wherein the undersaddle pickup subassembly includes sensor elements, the top surfaces and bottom surfaces of the sensor elements may have electrodes. In this case, the sensor elements will be electrically coupled to both inputs of the amplifier.

Figure 10:
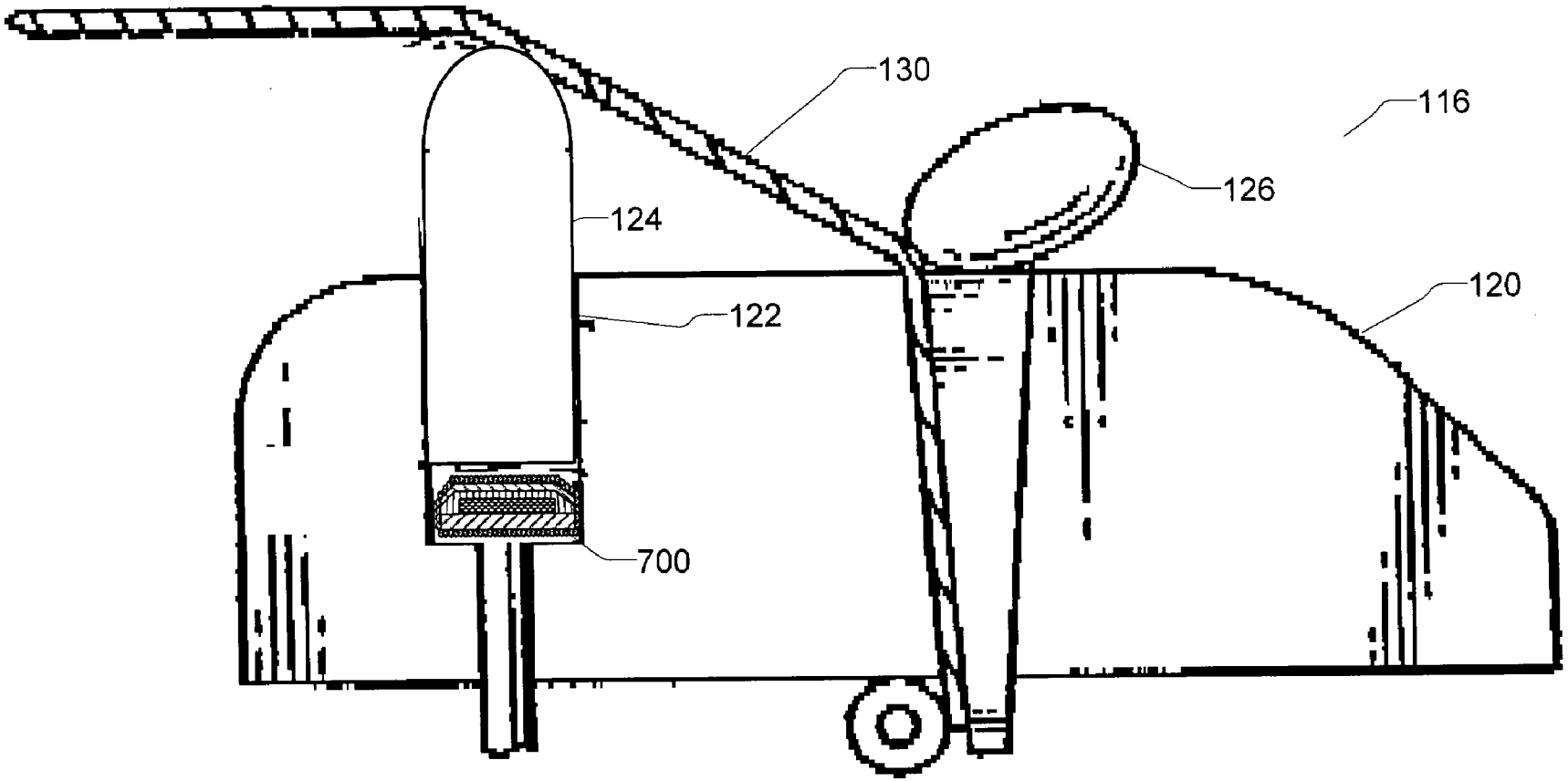
FIG. 10 is a semi-schematic cross-sectional view of an undersaddle pickup installed in a saddle slot in accordance with an exemplary embodiment of the present invention.

FIG. 10 is a semi-schematic cross-sectional view of an undersaddle pickup installed in a saddle slot in accordance with an exemplary embodiment of the present invention. A bridge assembly 116 includes a bridge plate 120 having a saddle slot 122 formed therein. The saddle slot receives a lowermost portion of a saddle 124. String retaining posts 126 anchor each string, such as string 130, to the bridge assembly at a first end portion of each string.

An undersaddle pickup 700 is disposed within the saddle slot of the bridge plate such that tension applied by the strings urges the saddle compressively against the undersaddle pickup. Thus, vibrations of the strings of the guitar are mechanically transferred through the saddle to the undersaddle pickup, which then converts the mechanical vibrations into electrical signals suitable for amplification.

Although this invention has been described in certain specific embodiments, many additional modifications and variations would be apparent to those skilled in the art. It is therefore to be understood that this invention may be practiced otherwise than as specifically described. Thus, the present embodiments of the invention should be considered in all respects as illustrative and not restrictive, the scope of the invention to be determined by any claims supported by this application and the claims' equivalents rather than the foregoing description.

What is claimed is:

1. A method of manufacturing a pickup for a stringed musical instrument, comprising:

providing a subassembly having an electrode;

providing a lead, the lead including:

a central conductor;

a conducting outer layer having an open end through which the central conductor extends; and an insulating layer between the central conductor and the conducting outer layer;

coupling the central conductor of the lead to the electrode of the subassembly; and inserting the subassembly into the open end of the conducting outer layer, whereby the lead's conducting outer layer surrounds the subassembly.

2. The method of claim 1, further comprising sealing the open end of the conducting outer layer.

3. The method of claim 2, wherein the open end of the conducting outer layer is sealed by soldering.

4. The method of claim 2, wherein the open end of the conducting outer layer is sealed by the use of an adhesive.

5. The method of claim 2, wherein the open end of the conducting outer layer is sealed by crimping.

6. The method of claim 1, further comprising swaging a portion of the conducting outer layer surrounding the subassembly.

7. The method of claim 1, wherein providing the subassembly further comprises:

providing a plurality of spaced apart electrodes on a top surface of an insulating substrate;

covering the spaced apart electrodes with a sensor material with an insulating layer therebetween; and creating a plurality of subassemblies by die-cutting between the spaced apart electrodes.

8. The method of claim 1, wherein providing the subassembly further comprises:

providing an insulating substrate;

placing a layer of conductive electrode material on a top surface of the insulating substrate;

covering the layer of conductive electrode material with a sensor material with an insulating layer therebetween to create a layered structure; and creating a plurality of subassemblies by die-cutting the layered structure.

9. The method of claim 1, the subassembly further comprising:

an insulating base with the electrode on a top surface of the insulating base; and a layer of sensor material covering the electrode.

10. The method of claim 9, wherein the base has a central portion and a peripheral portion with the electrode covering the central portion of the base and the layer of sensor material covering the electrode and the peripheral portion of the base.

11. The method of claim 9, wherein the subassembly further comprises an insulating layer between the sensor material and the electrode.

12. The method of claim 11, wherein the insulating layer between the sensor material and the electrode is an adhesive.

13. The method of claim 9, wherein the subassembly further comprises an insulating layer between the conducting outer layer and the sensor material of the subassembly.

14. The method of claim 1, the subassembly further comprising:

an insulating base having a top surface, the electrode on the insulating base's top surface;

an insulating tray having a first surface and a second surface with a well extending from the first surface to the second surface, the tray covering the electrode; and a sensor element located in the well of the tray.

15. The method of claim 14, wherein the subassembly further comprises an insulating layer between the sensor element and the electrode.

16. The method of claim 15, wherein the insulating layer between the sensor element and the electrode is an adhesive.

17. The pickup of claim 1, wherein the electrode is flat and elongated.

18. The pickup of claim 17, wherein the electrode is comprised of a contact portion, a neck portion, and an end portion that is wider than the neck portion, wherein the neck portion is connected to the contact portion and the end portion.

19. The method of claim 12, wherein the adhesive layer is made of a pressure sensitive material.

20. The method of claim 16, wherein the layer of sensor material adhesive layer is made of a pressure sensitive material.

21. A pickup for a stringed musical instrument, the pickup comprising:

a subassembly comprising:

an insulating base having a top surface;

an electrode on the top surface of the insulating base;

a layer of sensor material covering the electrode; and an insulating layer between the sensor material and the electrode.

22. The pickup of claim 17, wherein the pickup further comprises an outer conductor covering the subassembly.

23. The pickup of claim 17, wherein the insulating layer between the sensor material and the electrode is an adhesive.

24. The pickup of claim 22, further comprising an insulating layer between the outer conductor and the sensor material of the subassembly.

25. The pickup of claim 23, wherein the adhesive layer is made of a pressure sensitive material.

26. A pickup for a stringed musical instrument, the pickup comprising:

a subassembly comprising:

an insulating base having a top surface;

an electrode on the top surface of the insulating base;

a layer of sensor material covering the electrode; and an outer conductor covering the subassembly, wherein the insulating base has a central portion and a peripheral portion with the electrode covering the central portion of the base and the layer of sensor material covering the electrode and the peripheral portion of the base.

27. A pickup for a stringed musical instrument, the pickup comprising:

a subassembly comprising:

an insulating base having a central portion and a peripheral portion;

an electrode covering the central portion of the base;

an insulating tray having a first surface and a second surface with a well extending from the first surface to the second surface, the tray covering the electrode and the peripheral portion of the base; and a sensor element located in the well of the tray; and an outer conductor covering the subassembly.

28. The pickup of claim 27, wherein the subassembly further comprises an insulating layer between the sensor element and the electrode.

29. The pickup of claim 28, wherein the insulating layer between the sensor element and the electrode is an adhesive.

30. The pickup of claim 29, further comprising an insulating layer between the outer conductor and the sensor element of the subassembly.

31. The pickup of claim 29, wherein the adhesive layer is made of a pressure sensitive material.

32. An undersaddle pickup for a stringed musical instrument, the undersaddle pickup comprising:

an insulating base having a top surface;

an electrode on the top surface of the insulating base;

a layer of sensor material having a first surface coupled to the electrode through a layer of pressure sensitive adhesive; and an outer conducting layer surrounding the undersaddle pickup, the outer conducting layer coupled to a second surface of the sensor material.

33. The undersaddle pickup for a stringed musical instrument of claim 32, wherein the first surface of the sensor material includes a sensor electrode and the pressure sensitive adhesive is conductive, whereby the first surface of the sensor material is electrically coupled to the electrode.

34. The undersaddle pickup for a stringed musical instrument of claim 32, wherein the second surface of the sensor material includes a sensor electrode, whereby the second surface is electrically coupled to the outer conducting layer.

35. An undersaddle pickup for a stringed musical instrument, the undersaddle pickup comprising:

an insulating base;

an electrode on a top surface of the base; and a layer of sensor material having a first surface capacitively coupled to the electrode and a second surface capacitively coupled to an outer conducting layer.

36. The undersaddle pickup for a stringed musical instrument of claim 35, wherein the first surface of the sensor element includes a sensor electrode and the pressure sensitive adhesive is conductive, whereby the first surface of the sensor element is electrically coupled to the electrode.

37. The undersaddle pickup for a stringed musical instrument of claim 35, wherein the second surface of the sensor material includes a sensor electrode, whereby the second surface is electrically coupled to the outer conducting layer.

38. The undersaddle pickup of claim 35, wherein the electrode is flat and elongated.

39. The undersaddle pickup of claim 38, wherein the electrode is comprised of a contact portion, a neck portion, and an end portion that is wider than the neck portion, wherein the neck portion is connected to the contact portion and the end portion.

40. The pickup of claim 35, wherein the pickup further comprises a layer of pressure sensitive adhesive material between the sensor material and the electrode.

41. An undersaddle pickup for a stringed musical instrument, the undersaddle pickup comprising:

an insulating base;

an electrode on a top surface of the base;

an insulating tray having a first surface and a second surface with a well extending from the first surface to the second surface, the tray covering the electrode and the peripheral portion of the base; and a sensor element located in the well of the tray, the sensor element coupled to the electrode at a first surface through a layer of pressure sensitive adhesive; and an outer conducting layer surrounding the undersaddle pickup, the outer conducting layer coupled to a second surface of the sensor element.

42. A method of manufacturing a pickup for a stringed musical instrument, comprising:

providing a subassembly having an electrode;

providing a lead, the lead including:

a central conductor;

a conducting outer layer having an open end through which the central conductor extends; and an insulating layer between the central conductor and the conducting outer layer;

connecting the central conductor of the lead to the electrode of the subassembly; and retracting the subassembly into the open end of the conducting outer layer, whereby the lead's conducting outer layer surrounds the subassembly.

43. The method of claim 42, further comprising sealing the open end of the conducting outer layer.

44. The method of claim 43, wherein the open end of the conducting outer layer is sealed by soldering.

45. The method of claim 43, wherein the open end of the conducting outer layer is sealed by the use of an adhesive.

46. The method of claim 43, wherein the open end of the conducting outer layer is sealed by crimping.

47. The method of claim 42, further comprising swaging a portion of the conducting outer layer surrounding the subassembly.

48. The method of claim 42, wherein providing the subassembly further comprises:

providing a plurality of spaced apart electrodes on a top surface of an insulating substrate;

covering the spaced apart electrodes with a sensor material with an insulating layer therebetween; and creating a plurality of subassemblies by die-cutting between the spaced apart electrodes.

49. The method of claim 42, wherein providing the subassembly further comprises:

providing an insulating substrate;

placing a layer of conductive electrode material on a top surface of the insulating substrate;

covering the layer of conductive electrode material with a sensor material with an insulating layer therebetween to create a layered structure; and creating a plurality of subassemblies by die-cutting the layered structure.

50. The method of claim 42, the subassembly further comprising:

an insulating base with the electrode on a top surface of the insulating base; and a layer of sensor material covering the electrode.

51. The method of claim 50, wherein the base has a central portion and a peripheral portion with the electrode covering the central portion of the base and the layer of sensor material covering the electrode and the peripheral portion of the base.

52. The method of claim 50, wherein the subassembly further comprises an insulating layer between the sensor material and the electrode.

53. The method of claim 52, wherein the insulating layer between the sensor material and the electrode is an adhesive.

54. The method of claim 50, wherein the subassembly further comprises an insulating layer between the conducting outer layer and the sensor material of the subassembly.

55. The method of claim 42, the subassembly further comprising:

an insulating base having a top surface, the electrode on the insulating base's top surface;

an insulating tray having a first surface and a second surface with a well extending from the first surface to the second surface, the tray covering the electrode; and a sensor element located in the well of the tray.

56. The method of claim 55, wherein the subassembly further comprises an insulating layer between the sensor element and the electrode.

57. The method of claim 56, wherein the insulating layer between the sensor element and the electrode is an adhesive.

58. The method of claim 57, wherein the adhesive layer is made of a pressure sensitive material.

59. The method of claim 53, wherein the adhesive layer is made of a pressure sensitive material.

* * * * *